United States Patent [19]

Roberts

[11] 4,340,552

[45] Jul. 20, 1982

[54] MELT SPINNING SOLUTION DYED FILAMENTS AND IMPROVED SPIN PACK THEREFOR

[75] Inventor: John S. Roberts, Howell, N.J.

[73] Assignee: Kling-Tecs, Inc., Mantoloking, N.J.

[21] Appl. No.: 236,767

[22] Filed: Feb. 23, 1981

[51] Int. Cl.[3] ..... B28B 7/04

[52] U.S. Cl. ..... 264/39; 264/78; 264/176 F

[58] Field of Search ..... 264/176 Z, 39, 78; 425/198, 199, 197

[56] References Cited

U.S. PATENT DOCUMENTS

| | | | |
|---|---|---|---|
| 2,883,261 | 4/1959 | McGeorge | 425/198 |
| 2,947,598 | 8/1960 | Mavagliano et al. | 425/198 |
| 3,028,627 | 4/1962 | McCormick | 425/198 |
| 3,634,576 | 1/1972 | Stuchlik | 264/176 Z |
| 3,938,925 | 2/1976 | Lees | 425/198 |
| 3,969,312 | 7/1976 | Lees | 264/78 |
| 4,225,299 | 9/1980 | Roberts | 425/725 |

*Primary Examiner*—Jay H. Woo
*Attorney, Agent, or Firm*—Edward D. C. Bartlett

[57] ABSTRACT

A method of melt spinning solution dyed polypropylene filaments, with quicker color changes, comprises passing solution dyed polypropylene melt of a first color at a temperature below 400° F., particularly in the range 350° F. to 360° F., through a plurality of shallow horizontally disposed cavities in a spin pack. Each cavity contains a set of horizontally disposed mesh screens which occupies at least one-third of the depth thereof, the melt passing through all of the sets of mesh screens and occupying only a low internal volume in the spin pack as it passes therethrough and is extruded therefrom. Then, when it is needed to change color, natural polypropylene melt is passed through the spin pack and natural filaments extruded. Thereafter, solution dyed melt of a second color is passed through the spin pack and filaments of the second color extruded, the color change from the first color to the second color being effected quickly and completely by purging through the spin pack.

6 Claims, 9 Drawing Figures

MELT SPINNING SOLUTION DYED FILAMENTS AND IMPROVED SPIN PACK THEREFOR

FIELD OF THE INVENTION

This invention relates to melt spinning solution dyed filaments of thermoplastic material, particularly polypropylene, and to spin packs for use therefor.

BACKGROUND OF THE INVENTION

The use of a single breaker plate in spin packs is known. Also, the use of various filtering media in spin packs is known; filtering media such as sand, cintered metal, and wire mesh screens have been proposed and used.

When extruding non-pigmented, or natural, synthetic yarn, the life of the spin pack depends to a certain extent of the effectiveness of the filtering media. Spin packs normally have to be changed when either the pressure of the melt in the pack becomes too high due to the filtering media clogging, or when the distribution at the spinnerette has deteriorated so that too many yarns are outside the denier specification being used. Sometimes a pack seal leaks and causes the spin pack to be changed. More occasionally, a spin pack has to be changed because one or more capillaries becomes blocked or partially blocked. Pack changing necessitates interrupting extrusion, and apart from the down time involved, causes substantial waste as the spin system is "threaded-up" again.

The problems of down time and waste associated with melt spinning solution dyed yarns or filaments, such as solution dyed polypropylene, are far more severe. In addition to the problems mentioned above with natural yarns, two further problems exist; namely, the additional clogging of the filtering media by the color pigments, some of which clog more readily than others, and the necessity to change color. Color changing is frequently accompanied by a pack change, and also with a long purge without packs to clean out from the spin system traces of the previous color before putting in new packs and introducing the new color. This becomes very costly if only a short run of a particular color is required, for example, 5000 pounds or less, and even more so if 1,000 pounds or less is required.

Another problem that occurs sometimes is that a spin pack is incorrectly or poorly assembled. This is not discovered until the extrusion line is brought up and the pack malfunctions. The line then has to be brought down again and the faulty pack changed causing more down time and waste. Some causes of this are incorrectly positioned seals and incorrectly located filtering media.

SUMMARY OF THE INVENTION

The present invention is particularly concerned with the problems associated with color changes. But, it is also concerned with other factors that shorten the life of spin packs, such as, deterioration of distribution of the melt at the spinnerette, pack leaks, and incorrect assembly.

Accordingly, it is an object of the present invention to provide a spin pack which enables color changes to be made more frequently by purging through the spin pack.

It is a further object of the invention to provide a spin pack with which color changes effected by purging through the spin pack can be accomplished quicker and more completely.

It is yet another object of the invention to provide a spin pack, particularly a rectangular spin pack, with improved and reliable sealing which reduces the occurrence of leaks.

It is still another object of the invention to improve the distribution of the melt at the spinnerette.

It is also an object of the invention to provide an improved spin pack that can be easily assembled.

Yet another object of this invention is to provide a method of extruding solution dyed yarns, particularly polypropylene, in which color changing can more efficiently be effected.

Toward the accomplishment of the aforementioned objects and others which will become apparent from the following description and accompanying drawings, there is disclosed a spin pack for use in melt spinning solution dyed filaments of thermoplastic material, particularly polypropylene, comprising a hollow pack body, a spinnerette mounted in the bottom of said pack body, at least one breaker plate contained in said pack body, and a cover plate mounted at the top of said pack body. The cover plate, breaker plate, and spinnerette define between them a plurality of shallow horizontally disposed cavities. Each cavity has a depth substantially less than the thickness of the spinnerette; preferably this depth is less than 0.35 inches, and may be less than 0.3 inch. A set of mesh screens is contained in each cavity, the thickness of each set of screens being at least one-third of the depth of the cavity containing that set of screens; this thickness may be about half the depth of the respective cavity. The spin pack has a low internal volume for occupancy by the melt as it passes therethrough. In use, the sets of screens both filter the melt and aid even distribution of the latter across the spinnerette; the melt passes through the cavities relatively rapidly enabling color changes made by purging through the pack to be accomplished more quickly and completely.

Preferably there are at least two breaker plates which may be of substantial thickness relative to the depth of the shallow cavities. Each breaker plate has a plurality of holes therethrough connecting adjacent cavities. Preferably the breaker plates are identical and interchangeable. Each breaker plate may have one of the cavities formed completely in the upper part thereof. A very shallow seating is disposed around the periphery of each cavity, and a deformable seal is disposed in each seating. The cover plate is bolted to the pack body with the cover plate making physical contact with the upper breaker plate, the latter physically contacting another breaker plate, and the lowest breaker plate in turn physically contacts the spinnerette. The seals are so dimensioned that each is squeezed to a limited amount in its respective seating and remains totally confined within the depth of its respective seating. Another seal may be squeezed between the cover plate and the periphery of the top set of screens.

One of the cavities is formed in the spinnerette, and is preferably completely so formed. The cavity in the spinnerette is preferably identical in shape to the other cavities, but may be approximately half the depth of the latter. The spinnerette has a plurality of capillaries therein which are arranged out of alignment with the holes through the breaker plates. The sets of holes through the breaker plates may be in alignment with each other.

Each set of mesh screens preferably contains at least five screens superimposed on each other. Each set of screens preferably contains at least one 50 mesh screen, at least one 100 mesh screen, and at least one 325 mesh screen.

The pack body, cover plate, breaker plates, spinnerette, and the cavities may be circular in horizontal section; however, they are preferably rectangular in horizontal section so that the capillaries in the spinnerette can be grouped together into a plurality of groups for the production of a plurality of multifilament yarns, the groups being spaced apart in a direction parallel to the longer sides of the rectangular spinnerette.

There is also provided, according to the present invention, in a method of melt spinning solution dyed polypropylene filaments through a spin pack containing a spinnerette, and in which color changes need from time to time to be made without changing the spin pack, the step comprising passing the solution dyed polypropylene melt of a first color at a temperature below 400° F. through a plurality of shallow horizontally disposed cavities in the spin pack, each of the cavities containing a set of horizontally disposed mesh screens which occupies at least one-third the depth of the cavity so occupied, the solution dyed melt passing through all of the sets of mesh screens, and the solution dyed melt occupying only a low internal volume in the spin pack as the melt passes therethrough. The solution dyed melt is extruded through the spinnerette to form solution dyed filaments of the first color. Then, when it is needed to change color, natural polypropylene melt is passed through the spin pack and natural filaments extruded. Thereafter, solution dyed melt of a second color is passed through the spin pack and solution dyed filaments of the second color extruded, the color change from the first color to the second color being effected quickly and completely by purging through the spin pack.

The preferred embodiment of the invention will now be described in greater detail with reference to the accompanying drawings.

DESCRIPTION OF SPECIFIC EMBODIMENTS

Figure 1:
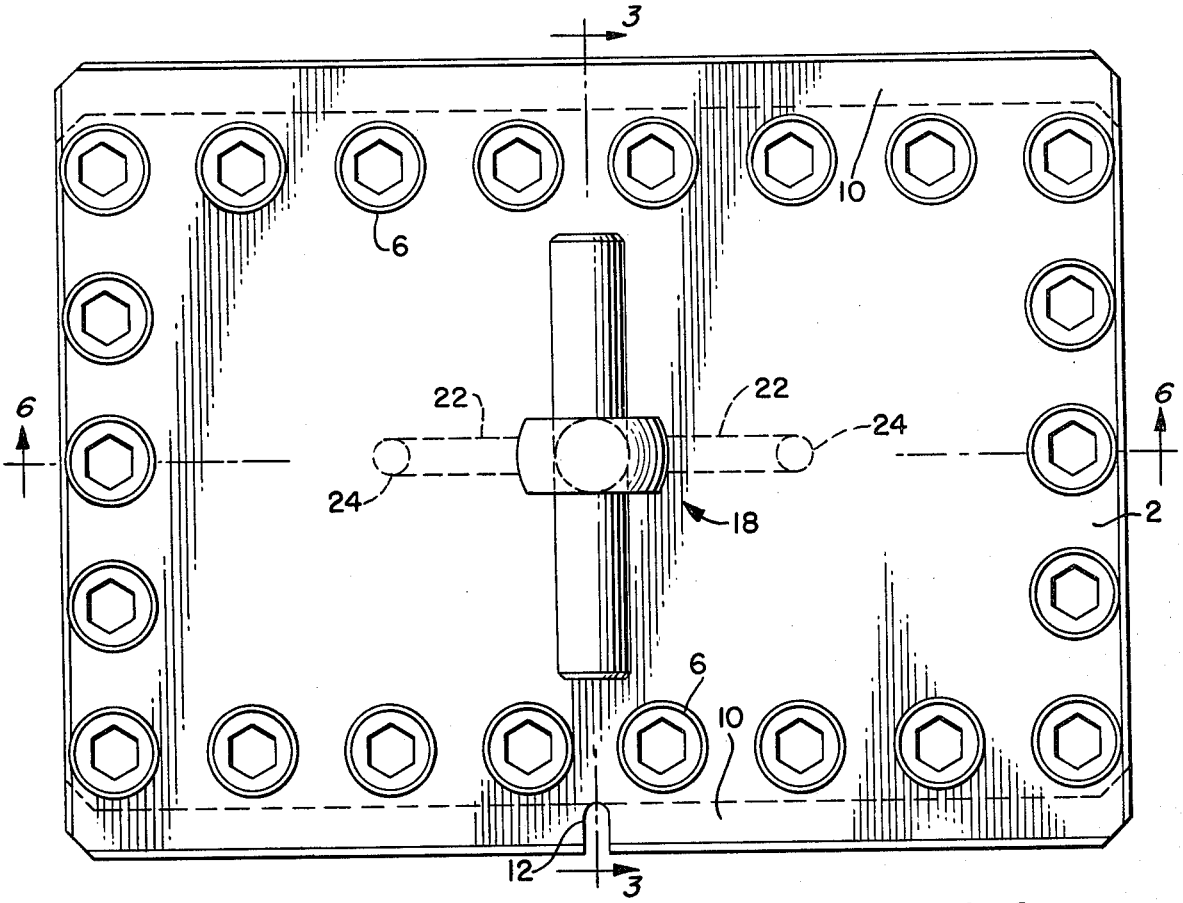
FIG. 1 is a plan view of a spin pack according to the invention.
Figure 2:
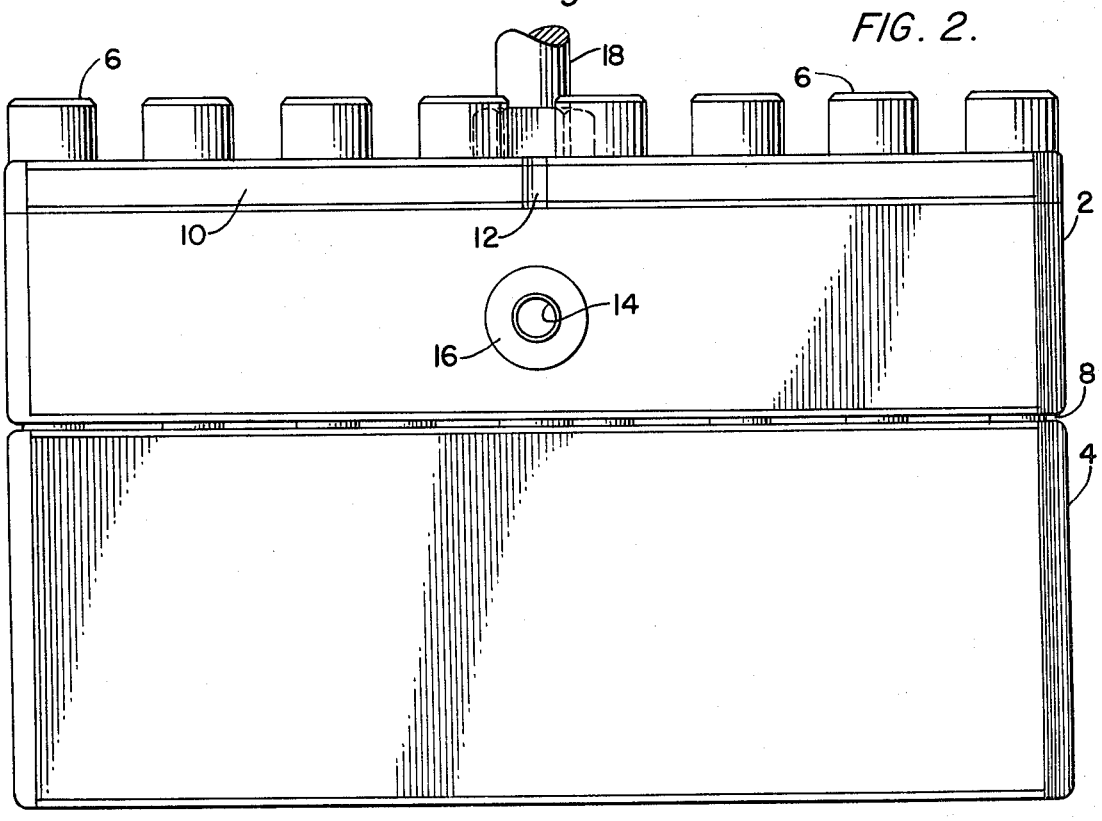
FIG. 2 is a side elevation of the spin pack, with most of the handle omitted for simplicity.

The spin pack is rectangular in horizontal planes, and FIG. 1 shows a top view of the cover plate 2. FIG. 2 shows in side view the cover plate 2 bolted to the pack body 4 by bolts 6 which pass right through to the bottom of the pack body 4, as will be described more fully later. There is a small gap 8 between the cover plate 2 and the pack body 4. As can be seen in FIG. 1, there are 22 bolts 6 around the periphery of the cover plate 2. Along the two longer sides of the cover plate 2 extend flanges 10. A notch 12 is formed in the center of one of the flanges 10 and, in use, engages a pin on a spin block of an extrusion line (not shown) to correctly locate the spin pack in position. Below the notch 12 is an inlet port 14 through which melt enters the spin pack from the spin block. Around the port 14 is an annular seal 16. The cover plate 2 is provided with a handle 18 by means of which the spin pack can be raised, lowered, and moved by a hoist. For simplicity, most of the handle 18 has been omitted in FIG. 2.

Figure 3:
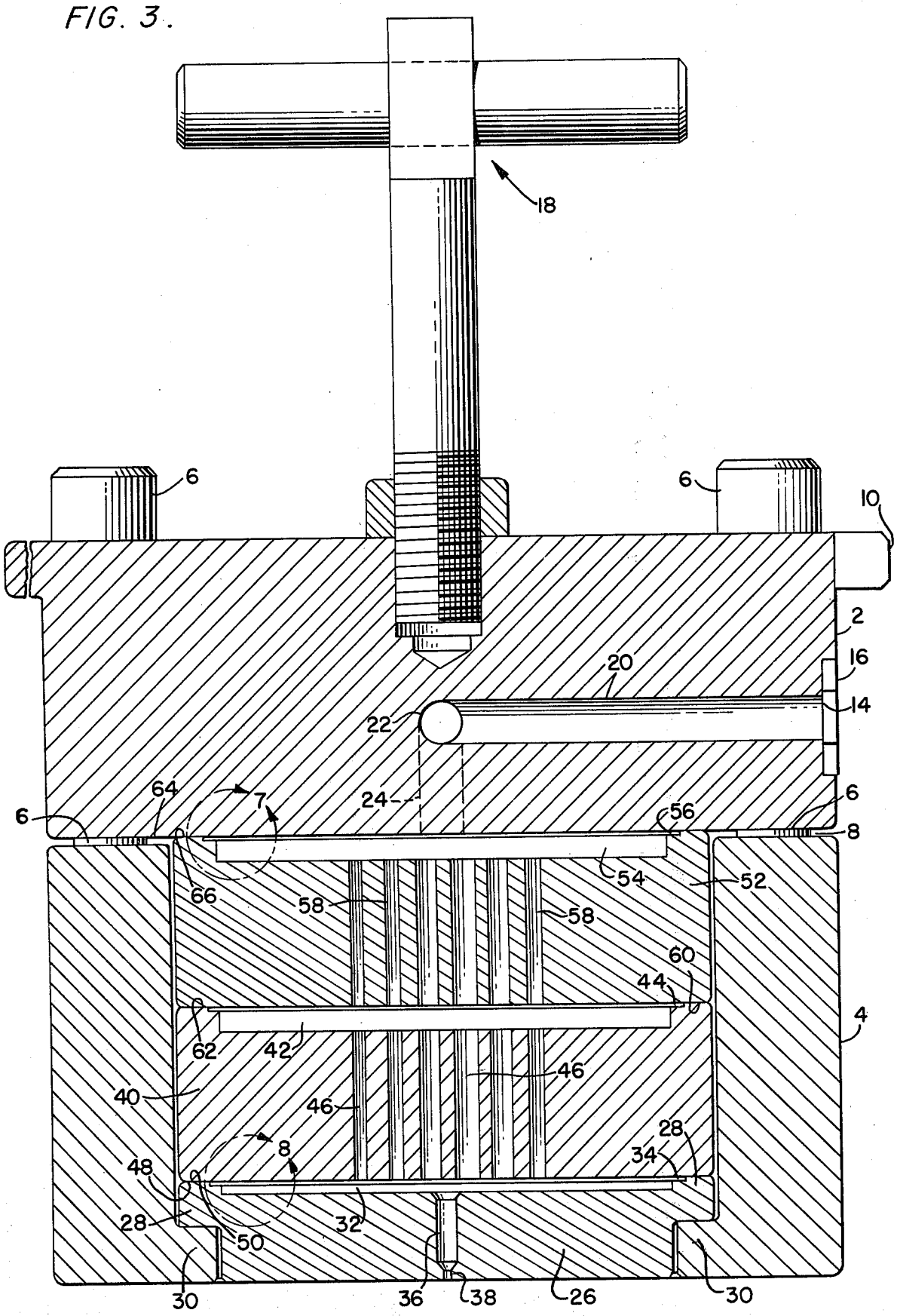
FIG. 3 is a section on the line 3—3 of FIG. 1.

FIG. 3 shows a passageway 20 leading from the inlet port 14 to the center of the cover plate 2 where the passageway 20 communicates with another passageway 22 extending lengthwise through the cover plate 2 (see FIG. 1). The ends of the passageway 22 communicate with passageways 24 which extend vertically downwardly through the bottom of the cover plate 2. The passageway 22 is approximately one-third of the length of the cover plate 2. The handle 18 is clearly shown in FIG. 3. A spinnerette 26 is retained in the bottom of the pack body 4 by a flange 28 around the periphery of the spinnerette 26 engaging an inwardly extending flange 30 around the bottom of the pack body 4. A shallow cavity 32 is formed in the top of the spinnerette 26 and a very shallow recess 34 is formed around the periphery of the cavity 32. The spinnerette 26 is formed with a plurality of bores 36 therethrough, each bore having at its lower end a capillary 38. For simplicity, only the center bore 36 in the cross-section is shown in FIG. 3. Above the spinnerette 26, and in contact therewith, is a lower breaker plate 40 having a shallow cavity 42 in its upper surface. Around the periphery of the cavity 42 is a very shallow recess 44. Passing through the breaker plate 40 are a great number of vertical holes 46 all of which have the same diameter (see FIG. 4). The lower surface 48 of the breaker plate 40 extends across the top of the cavity 32 and is in physical contact with the upper surface 50 of the spinnerette 26 externally of the recess 34. Above, and in contact with the breaker plate 40 is an upper identical breaker plate 52 having a shallow cavity 54 in its upper surface around the periphery of which extends a very shallow recess 56. The upper breaker plate 52 has vertical holes 58 therethrough, each hole 58 being in line with a corresponding hole 46 in the lower breaker plate 40. The lower surface 60 of the upper breaker plate 52 extends across the top of the cavity 42 and physically contacts the upper surface 62 of the lower breaker plate 40 externally of the recess 44. The lower surface 64 of the cover plate 2 extends across the top of the cavity 54 and physically contacts the upper surface 66 of the upper breaker plate 52 externally of the recess 56. The pack body 4, spinnerette 26, and the two breaker plates 40,52 are so dimensioned that when the bolts 6 are fully tightened to clamp all the pack parts together, the small gap 8 remains between the cover plate 2 and the pack body 4. This is to ensure that metal to metal contact is made between adjacent parts around the peripheries of the two breaker plates 52,40 and the spinnerette 26. The contents of the cavities 54,42 and 32 as well as seals that are located in the recesses 56,44 and 34 have been omitted from FIG. 3 to more clearly show these cavities and recesses. However, the omitted parts will be described later with reference to FIGS. 7 and 8.

Figure 4:
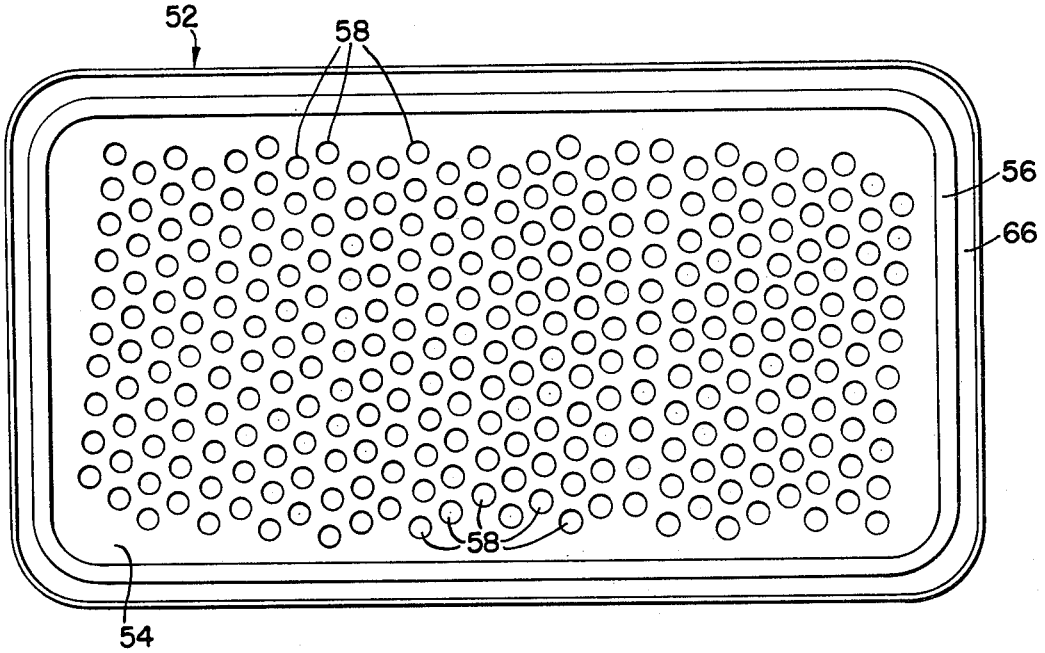
FIG. 4 is a plan view of a breaker plate of the spin pack.

FIG. 4 shows a top plan view of the breaker plate 52. As can be seen, the shallow cavity 54 extends across most of the top of the breaker plate and has the very shallow recess 56 extending completely around the periphery of the cavity 54. There are 290 holes 58 arranged in a pattern across substantially the whole of the bottom of the cavity 54. The holes 58 are arranged in lengthwise and transverse rows, the transverse rows being at an angle of 5° to the transverse direction parallel to the shorter sides of the breaker plate, and the longitudinal rows being at an angle of 5° to the lengthwise direction of the breaker plate parallel to its longer sides. As can be seen, the upper peripheral surface 66 of the breaker plate 52, that makes metal to metal contact with the lower surface of the cover plate 2, extends entirely around the periphery of the recess 56. The lower breaker plate 40 is identical to and interchangeable with the upper breaker plate 52.

Figure 5:
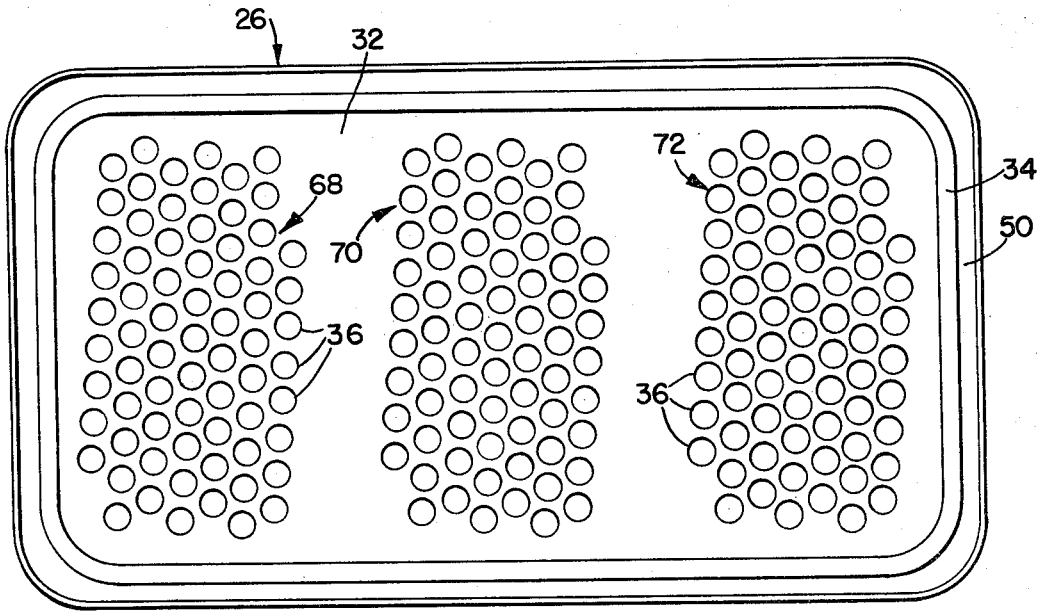
FIG. 5 is a plan view of the spinnerette of the spin pack.

FIG. 5 is a top view of the spinnerette 26 showing the cavity 32 therein extending over most of the top surface of the spinnerette 26 and being surrounded by the recess 34 which in turn is surrounded around the periphery of the spinnerette by the upper surface 50 of the spinnerette. The bores 36 through the spinnerette are arranged in three groups 68,70, and 72 spaced apart lengthwise of the spinnerette with each group containing 70 bores 36 for the production of three 70 filament yarns. The bores 36 and their capillaries are out of alignment with the holes 58 and 46 in the breaker plates.

Figure 6:
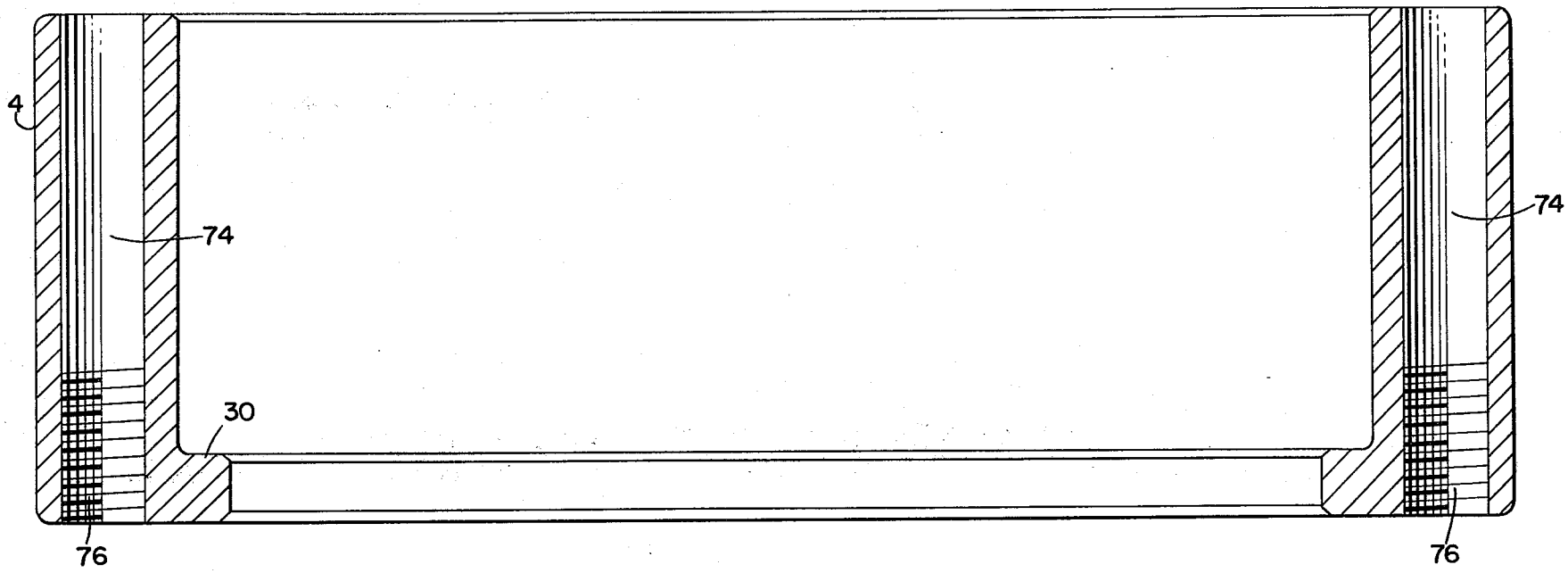
FIG. 6 is a section on the line 6—6 of FIG. 1 of the body of the spin pack.

FIG. 6 is a longitudinal vertical section of the pack body 4 and shows bores 74 extending vertically completely through the side walls of the pack body 4. The lower portion 76 of each bore is screw-threaded for receiving the ends only of the bolts 6. The bores for all the bolts 66 are the same as those shown in FIG. 6. With this arrangement, when the bolts 66 are fully torqued, the shearing forces on the side walls of the pack body 4, particularly in view of the gap 8, are minimized. This reduces the risk of the pack body 4 fracturing or cracking.

Figure 7:
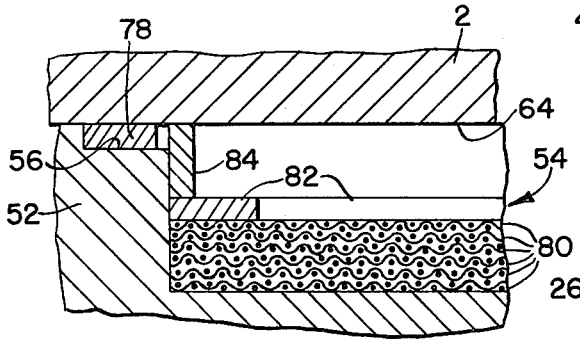
FIG. 7 is a fragmentary diagrammatic sectional view, on a larger scale, of a portion of FIG. 3.

FIG. 7 shows diagrammatically, on a larger scale, the lefthand portion of the cavity 54 in FIG. 3, but with the various seals and mesh screens in place. A closed seal 78 is located in the recess 56. In plan view the seal 78 has substantially the same shape as shown in FIG. 4 for the recess 56. Before the seal 78 is positioned in the pack, it has a thickness slightly greater than the depth of recess 56 and a width slightly less than the width of the recess 56. In the bottom of the cavity 54, and occupying between a third and a half of the depth of the cavity 54, are six superimposed wire mesh screens each of which extends over the full area of the cavity 54. On top of and around the periphery of the set of screens 80 is a seal 82 which is similar to seal 78 but dimensioned so that it just fits in the cavity 54. Instead of the seal 82 being a closed seal, it can be made from a seal identical to seal 78 by cutting a short length out of the middle of each side of the seal 78, and then placing the four remaining parts of the seal 78 on top of and around the periphery of the set of screens 80. Between the seal 82 and the underside 64 of the cover plate 2 is an upstanding closed seal 84 which extends completely around the periphery of the cavity 54. The cavity 42 similarly has a set of six wire mesh screens 80 in the bottom thereof and occupying between a third and a half of the depth of cavity 42; also, the recess 44 has therein a seal identical to the seal 78. However, the seals 82 and 84 are omitted from cavity 42.

Figure 8:
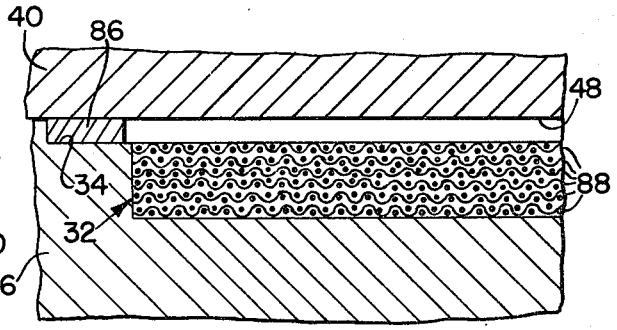
FIG. 8 is a fragmentary diagrammatic sectional view, on a larger scale, of another portion of FIG. 3.

FIG. 8 is a similar view to FIG. 7 but showing the lefthand portion of the cavity 32 in the spinnerette 26. In the recess 34 is a seal 86 identical to the seal 78 described above. The depth of the cavity 32 is half the depth of each of the cavities 54 and 42. Placed in the bottom of the cavity 32 are six superimposed wire mesh screens 88 which extend over the entire surface area of the cavity 32. This set of screens 88 occupies about three-quarters or more of the depth of the cavity 32. These screens 88 extend over the bores 36 in the spinnerette 26 with the bottom screen 88 actually covering the entrances to the bores 36.

To assemble the spin pack, a selected set of screens 88 is placed completely in the cavity 32 in the spinnerette 26. The seal 86 is placed in the recess 34, and then the spinnerette 26 is placed in the bottom of the pack body 4 with the bottom flange 30 supporting the spinnerette flange 28. A selected set of screens 80 is placed in the bottom of the cavity 42 of the lower breaker plate 40, and a seal 78 is placed in the recess 44, after which the lower breaker plate 40 is placed in the pack body 4 on top of the spinnerette 26. The upper breaker plate 72 is likewise assembled but with the additional inclusion of the seals 82,84, and the assembled upper breaker plate 52 is then placed in the pack body on top of the lower breaker plate 40. The cover plate 2 is placed on the top of the upper breaker plate 52 and the bolts 6 are inserted through the cover plate 2 and screwed into the lower screw-threaded portions 76 of the bores 74. All the seals 78,82,84, and 86 are made of soft, almost pure aluminum. When the bolts 6 are torqued down, the seals 78 and 86 are deformed until the major pack parts make metal to metal contact. At the same time, the upstanding seal 84 is pressed downwardly by the lower surface 64 of the cover plate 2 to cause the seal 82 to be pressed down on the periphery of the set of screens 80 to form a seal there around. When the pack is heated up, the seals 78 and 86, squeezed between the bottom of their respective recesses and the surfaces above them, tend to "flow" and form a perfect seal preventing any outward leakage of melt from the spin pack.

This embodiment of the spin pack has the following dimensions:

length of breaker plates 52,40—8.75 inches
width of breaker plates 52,40—4.75 inches
thickness of breaker plates 52,40—1.5 inches
thickness of spinnerette 26—0.865 inches
depth of breaker plate cavities 54,52—0.234 inches
depth of spinnerette cavity 32—0.117 inches
depth of seal recesses 56,44,34—0.028 inches
depth or thickness of the sets of screens 80,88—0.103 to 0.105 inches The wetted area of each of the cavities 54,42,32 is 31.92 square inches; the wetted area is the area of the bottom of each cavity ignoring the holes or bores therein. The gross volume of each of the breaker plate cavities is 7.47 cubic inches, and the gross volume of the spinnerette cavity is 3.73 cubic inches. Thus, the ratio of the volume of each breaker plate cavity to the wetted area of that cavity, expressed as a percentage, is approximately 23 percent; preferably this ratio should be less than 33 percent and more preferably less than 25 percent.

The volume of the holes 58 in each breaker plate is 5.51 cubic inches. The net volume of each breaker plate cavity when occupied by the mesh screens is theoretically 5.73 cubic inches, and the corresponding net volume of the spinnerette cavity theoretically 2.52 cubic inches. Thus, the net interior volume of the spin pack below the cover plate 2 and above the bores 36 in the spinnerette 26 is approximately 25 cubic inches (with the sets of screens in place). This is very low compared with the total internal volume of the pack body 4 which is approximately 140 cubic inches above the flange 30.

It should be noted that the depth of the breaker plate cavities is approximately 27 percent of the thickness of the spinnerette, and preferably should not exceed 33 percent of the thickness of the spinnerette. Also, the depth of the spinnerette cavity is approximately 13.5 percent of the thickness of the spinnerette, and again it is preferable that this should not exceed 33 percent of the thickness of the spinnerette.

This spin pack is particularly suitable for use in the air quench extrusion apparatus disclosed in my U.S. Pat. No. 4,225,299 and with the process of extruding multifilament polypropylene yarn disclosed in my U.S. Pat. No. 4,193,961, and both of these U.S. patents are hereby incorporated by reference. When so using the spin pack, the formation of the sets of wire mesh screens in the direction of flow of the melt through the spin pack were as follows:

| In Cavity 54 | In Cavity 42 | In Cavity 32 |
|---|---|---|
| 100 mesh | 50 mesh | 50 mesh |
| 150 mesh | 200 mesh | 325 mesh |
| 325 mesh | 325 mesh | 100 mesh |
| 150 mesh | 200 mesh | 50 mesh |
| 100 mesh | 100 mesh | 100 mesh |
| 50 mesh | 50 mesh | 50 mesh |

The mesh number is the number of openings per square inch. Different meshes have different wire sizes, but with each of the above wire mesh screens the open area formed by the many openings is approximately 30 percent of the total area of the screen. More or less screens could be used depending upon the melt being extruded; however, there should be at least three screens, and preferably at least five. It should be noted that a fine mesh screen should be supported on each side by a less fine mesh screen, and there should be a coarse mesh screen at the top and bottom of each set for mechanical support. The top set of screens in the cavity 54 primarily functions to filter the melt passing through the spin pack, and the sets of screens in the cavities 42 and 32 primarily function to improve the distribution of the melt across the spinnerette 26.

Eight spin packs with the screen makeups listed above were used in the extrusion apparatus of U.S. Pat. No. 4,225,299 with the process of U.S. Pat. No. 4,193,961 to produce 300 denier 70 filament solution dyed polypropylene yarn. The resin used was Hercules Profax PC 961 having a melt flow in the range 38 to 42 and a swell value, or die swell, in the range 1.2 to 1.7. Various color pigments were used and the colors referred to by number are equivalent to the colors listed under that number in the published fiber color charts of Hercules Incorporated. The extrusion line was run at the rate of approximately 21 pounds per hour per spin pack. One of the objects was to test how effectively color changes could be purged through the spin packs, and also to ascertain the life of the spin packs under these conditions before they had to be changed.

EXAMPLE 1

With the extrusion line producing 634 brown multifilament polypropylene yarn, the feed of color pigment pellets to the extrusion hopper was cut off, and then the line doffed which took approximately five minutes. While the line was being doffed, the color hopper was removed and cleaned, and then a small amount of natural resin pellets were fed into the color hopper to help remove any residual odd color pellets left in the hopper system. Approximately ten minutes from the time the feed of color pellets was cut off, all the yarns being extruded had turned to natural without a trace of the color.

EXAMPLE 2

With the extrusion line producing furnace black solution dyed polypropylene, the same procedure as Example 1 was operated. This time, approximately fifteen minutes after the black color pellets had been cut off, the extrusion line was producing all natural yarns without a trace of black.

EXAMPLE 3

The same procedure as used in the previous examples was employed, but after the extrusion was producing all natural yarns without a trace of color then the next color to be extruded was fed into the hopper system, and approximately five minutes after this occurred all the yarns being extruded were on color on the new color. Over a 20-day period of continuous extrusion, thirteen colors were run consecutively as follows, this involving twelve color changes all made by purging through the spin packs:

634 Brown to 634 Brown (different pigment formulation) to 646 Brown to 646 Brown (different pigment formulation) to 680 Brown to 680 Brown (different pigment formulation) to 636 Beige to 678 Beige to 636 Beige to 679 Beige to White to 461 Gold to Black.

At the end of the 20 days, and after having made the twelve color changes, approximately half of the spin packs employed in the extrusion line had not been changed.

Factors contributing to the ability to be able to purge through these spin packs so quickly and completely when changing color are believed to be as follows. There are no blind spots in the spin packs and the melt continuously drains from all areas leaving no stagnant pools. Also, the melt flows through the cavities containing the sets of screens rapidly, and the low net internal pack volume through which the melt passes results in a short residency time (of the order of 2½ minutes or less) of the melt in the spin pack. Another factor is believed to be that sufficiently high back pressures are created in the spin pack to ensure uniform flow of the melt. The lower breaker plate with its set of screens and the positioning of screens in the spinnerette are believed to considerably aid uniform distribution with such a severe hydraulic split whereby three 70 filament yarns are extruded from the same spinnerette.

One factor, that was surprisingly found to affect the speed and completeness with which color changes could be purged through the spin packs, was the temperature of extrusion of the narrow molecular weight distributed polypropylene. At extrusion temperatures between 400° F. and 385° F. reasonable results were obtained. However, when the extrusion temperature was further lowered, particularly to the range 350° F. to 360° F., exceptional results were obtained. Packs run for some time using this lower extrusion temperature range to produced solution dyed yarns, were taken to pieces hot and internally checked immediately the line had been purged for ten minutes to natural. Not a trace of the previous color pigments were found in the packs when broken down.

This spin pack was designed to operate at pressures up to 5,000 pounds per square inch. However, these packs have been tested up to 10,000 pounds per square inch before they exhibited any signs of leaking, and this was then believed to be due to the bolts 6 having been stretched to their yield point.

Figure 9:
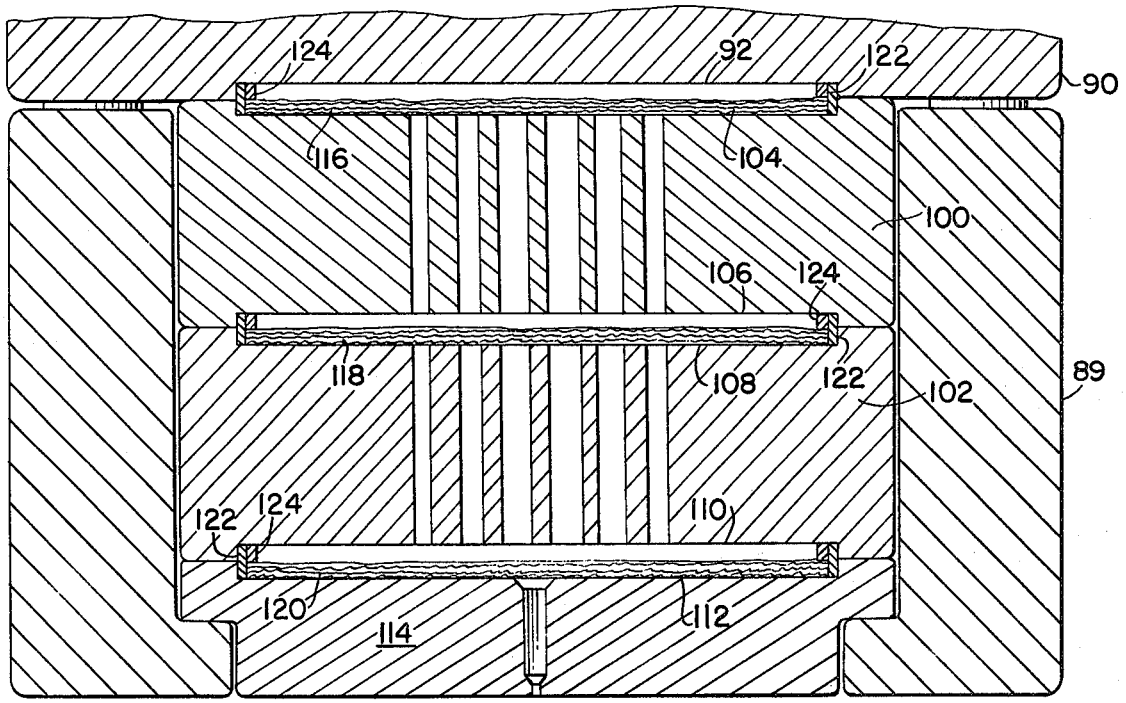
FIG. 9 is a sectional view similar to FIG. 3, with some parts omitted for simplicity, of another embodiment of the invention.

FIG. 9 is a similar view to FIG. 3, with some parts broken away, of another embodiment of the spin pack. In most aspects, this embodiment is the same as that previously described with reference to FIGS. 1 through 8, with the main differences being the disposition of the cavities and a different sealing arrangement. The pack body 89 is the same; the cover plate 90 is the same except that it has a shallow rectangular cavity 92 in its lower face. The upper breaker plate 100 is the same as previously described except that it has identical shallow cavities 104 and 106 in its upper and lower surfaces, respectively. The lower breaker plate 102 is identical to the upper breaker plate 100 and has similar cavities 108 and 110 in its upper and lower surfaces, respectively. The spinnerette 114 is the same as the spinnerette 26 having a cavity 112 which is identical to the cavity 32, but with no sealing recess around the periphery of the cavity 112. The cavities 92 and 104 together form a cavity of the same dimensions as the cavity 54. Similarly the cavities 106 and 108 together form a cavity of the same dimensions as the cavity 42. However, the cavities 110 and 112 together form a cavity of twice the depth of the cavity 32 and identical in dimensions to the other cavities. The cavities 104,108, and 112 contain sets of wire mesh screens 116,118, and 120, respectively, similar to the sets of screens previously described. The peripheries of the cavities are sealed by an upright closed seal 122 squeezed within the depth of each cavity, and a thinner closed seal 124 which is squeezed against the upper periphery of the respective set of screens. The spin pack of this embodiment is designed to be able to effect color changes rapidly by purging through the pack; however, the sealing arrangement has not withstood pressures approaching 5,000 pounds per square inch without exhibiting leakage tendencies, and for this reason the embodiment described in relation to FIGS. 1 through 8 is preferred.

The above described embodiments, of course, are not to be construed as limiting the breadth of the present invention. Modifications, and other alternative constructions, will be apparent which are within the spirit and scope of the invention as defined in the appended claims.

What is claimed is:

1. A method of melt spinning solution dyed polypropylene filaments with quicker color changes, comprising:

passing solution dyed polypropylene melt of a first color at a temperature below 385° F. through a spin pack containing a spinnerette having a plurality of capillaries therein;

passing the solution dyed melt downwardly through at least three shallow horizontally disposed cavities while passing through said spin pack, each of said cavities containing a set of mesh screens which occupies at least one-third the depth of the cavity so occupied and through which sets of screens said melt passes, one of said sets of screens being in contact with the spinnerette; and extruding the solution dyed melt through said capillaries to form a plurality of solution dyed filaments of said first color;

then, when it is needed to change color, cutting off said first color and passing natural polypropylene melt through said spin pack without interrupting extrusion; and immediately thereafter, without interrupting extrusion, passing solution dyed polypropylene melt of a second color through said spin pack to form a plurality of filaments of said second color, the color change from said first color to said second color being effected quickly and completely by purging through said spin pack.

2. The method recited in claim 1 in which the polypropylene melt has a temperature below 360° F., and the volume of each said cavity is less than one-third of the wetted area of that cavity.

3. In a method of melt spinning solution dyed polypropylene filaments through a spin pack containing a spinnerette, and in which color changes need from time to time to be made without changing the spin pack, the steps comprising:

passing the solution dyed polypropylene melt of a first color at a temperature below 400° F. through a plurality of shallow horizontally disposed cavities in the spin pack, each of the cavities containing a set of horizontally disposed mesh screens which occupies at least one-third of the depth of the cavity so occupied, the solution dyed melt passing through all of the sets of mesh screens, and the solution dyed melt occupying only a low internal volume in the spin pack as said melt passes therethrough;

extruding the solution dyed melt through said spinnerette to form solution dyed filaments of said first color;

then, when it is needed to change color, passing natural polypropylene melt through said spin pack and extruding natural filaments; and thereafter passing solution dyed melt of a second color through said spin pack and extruding solution dyed filaments of said second color, the color change from said first color to said second color being effected quickly and completely by purging through said spin pack.

4. A method of melt spinning solution dyed polypropylene with quicker color changes, comprising:

passing solution dyed polypropylene melt of a first color through a spin pack containing a spinnerette having a plurality of capillaries therein;

passing the solution dyed melt downwardly through a plurality of shallow horizontally disposed cavities while passing through said spin pack, each of said cavities containing a set of mesh screens and through which sets of screens said melt passes;

said melt occupying only a low internal volume in the spin pack as said melt passes therethrough;

extruding the solution dyed melt through said capillaries to form a plurality of solution dyed filaments of said first color;

then, when a desired quantity of said first color has been extruded, cutting off said first color and passing natural polypropylene melt through said spin pack;

immediately thereafter passing solution dyed polypropylene melt of a second color through said spin pack to extrude a plurality of filaments of said second color;

the melt being continuously extruded and having a temperature below 360° F.; and the color change from said first color to said second color being effected quickly and completely by purging through said spin pack.

5. The method recited in claim 4, in which said temperature is in the range 350° F. to 360° F.

6. The method recited in claim 4, in which each said cavity has a ratio of volume to wetted area of less than 33 percent.

* * * * *